United States Patent [19]

Valle et al.

[11] Patent Number: 4,676,292

[45] Date of Patent: Jun. 30, 1987

[54] TILTER APPARATUS FOR A SLATTED WINDOW COVERING

[75] Inventors: Louis G. Valle; Donald W. Luoto, both of Huntington Beach; Robert J. Voss, Fountain Valley, all of Calif.

[73] Assignee: Beatrice Companies, Inc., Denver, Colo.

[21] Appl. No.: 721,918

[22] Filed: Apr. 11, 1985

[51] Int. Cl.[4] ..... E06B 9/307

[52] U.S. Cl. ..... 160/176 R; 160/177

[58] Field of Search ..... 160/176 R, 176 B, 177

[56] References Cited

U.S. PATENT DOCUMENTS

| | | | |
|---|---|---|---|
| 3,333,905 | 8/1967 | Hennequin | 160/177 |
| 3,630,264 | 12/1971 | Debs | 160/177 |
| 3,828,838 | 8/1974 | Anderle et al. | 160/176 |
| 3,921,695 | 12/1975 | Debs | 160/177 |
| 4,143,699 | 3/1979 | Marotto | 160/176 R |
| 4,245,687 | 1/1981 | Vecchiarelli | 160/177 |
| 4,352,385 | 10/1982 | Vecchiarelli | 160/177 |
| 4,531,563 | 7/1985 | Nilsson | 160/177 |

*Primary Examiner*—Ramon S. Britts
*Assistant Examiner*—Cherney S. Lieberman
*Attorney, Agent, or Firm*—George J. Netter

[57] ABSTRACT

A venetian blind tilter mechanism housing has a first surface which bears against the front wall of the headrail, and a longitudinally extending slot on the surface facing the headrail back wall forming a spring plate which fits under a downwardly turned headrail back wall edge securing the housing within the headrail. The tilter mechanism has a spur gear received onto a control axle for common rotation. The spur gear has a smooth peripheral portion extending for a substantial angular extent that lacks gear teeth with conventional gear teeth over the remainder. An elongated shaft with a worm gear extends upwardly into the housing through an opening in the headrail bottom wall for meshing engagement with the spur gear.

2 Claims, 9 Drawing Figures

TILTER APPARATUS FOR A SLATTED WINDOW COVERING

The present invention relates generally to slatted window coverings or so-called venetian blinds, and more particularly to an improved apparatus for selectively tilting the various slats to a desired angular relation for controlling visibility and the passage of light therethrough and means for mounting such apparatus within the headrail.

BACKGROUND

A very popular type of window covering includes a plurality of separate slats which hang vertically from a headrail in front of the window. The slats can be raised or lowered to any predetermined height to allow a portion or substantially all of the window to be completely visible and permit the passage of light therethrough. In addition, the angular relationship of the slats to one another can be adjusted by a device frequently referred to as a "tilter" which angularly rotates the slats about the their longitudinal axes thereby varying the space between the slats through which light can pass.

A fully satisfactory tilter apparatus should provide means for preventing or reducing the amount of possible tilting force being applied to the slats when they have reached either of their two extremes in adjustment. Otherwise, if excessive force is applied to the slats at one of its extremes of adjustment, this can damage or break adjusting cords typically used to rotate the slats, or damage or substantially impair the functioning of the tilter apparatus itself.

In the past, approaches to solving this problem have included spring-loaded members or spring-loaded clutches which upon experiencing some predetermined amount of maximum force slips or otherwise interrupts the application of additional force to the tilting apparatus, and to the slats and adjustment cords as well. Such mechanisms are relatively expensive to manufacture and are subject to a relatively high-frequency failure rate in operation in that the springs either weaken or break leaving the apparatus nonfunctioning or perhaps leaving the entire tilter mechanism inoperative requiring repair or replacement of the mechanism, or in some case even replacement of the entire blind.

It has also been standard practice in the past to incorporate the tilter mechanism integrally within the headrail from which the blind is supported, by affixing the mechanism to the head rail through the use of rivets, screws or the like. When this is done, if there is any repair or replacement of the tilter mechanism this may result in the replacement of the entire headrail with included mechanism, or, in many cases, it may mean the complete loss of a functioning blind. Also, of course, the use of screws or rivets or other permanent securing means for locating a tilter mechanism within the headrail is a relatively expensive and complex manufacturing process.

However, it is essential that the tilter mechanism be anchored securely within the headrail since it experiences substantial reactive forces during tilting adjustment which, if not counterbalanced by a secure affixing to the headrail, could result in a complete dislodgement of the tilter mechanism and consequent failure of blind operation.

SUMMARY OF THE DISCLOSURE

The window covering to be described has a headrail housing that is elongated and generally U-shaped in cross section, with front and back walls integrally related to one another by a bottom wall, and with the top edges of the back and front walls being turned down into the housing cavity. A tilt angle control axle has its ends journaled within headrail housing end caps and extends longitudinally thereof. The tilter apparatus parts are contained within a two-piece plastic enclosure forming a unitary housing which is mounted directly onto the control axle.

The tilter mechanism housing has a first surface which, in assembly, bears against the front wall of the headrail, and a longitudinally extending slot on the surface facing the headrail back wall forming a springlike member which in assembly fits under the downwardly turned back wall edge of the headrail housing. In this manner the tilter housing is securely retained within the headrail at any predetermined location along the axle by being wedged between the front and back walls of the headrail. The springlike member can be depressed moving it from engagement with the turned down edge of the headrail back wall enabling ready release of the tilter mechanism housing for replacement or repair.

The tilter mechanism mounted within the enclosure includes a spur gear which is received onto the axle for rotation therewith. The spur gear has a smooth peripheral portion extending for a substantial angular extent that lacks gear teeth. An elongated shaft with a worm gear extends upwardly into the housing through an opening in the headrail bottom wall for meshing engagement with the spur gear.

Rotation of the worm gear in a first direction will drive the spur gear and thus the axle to effect adjustment of the slats in a first direction. Upon arriving at the untoothed portion of the spur gear, further rotation of the worm gear in the same direction produces no further adjusting movement and the two gears are no longer meshed. However, upon reversal of the direction of the worm gear, meshing will once again occur with the spur gear driving the axle and the blind slats in the reverse direction until at the other maximum of adjustment the untoothed portion of the spur gear is opposite the worm gear teeth.

DESCRIPTION OF A PREFERRED EMBODIMENT

Figure 1:
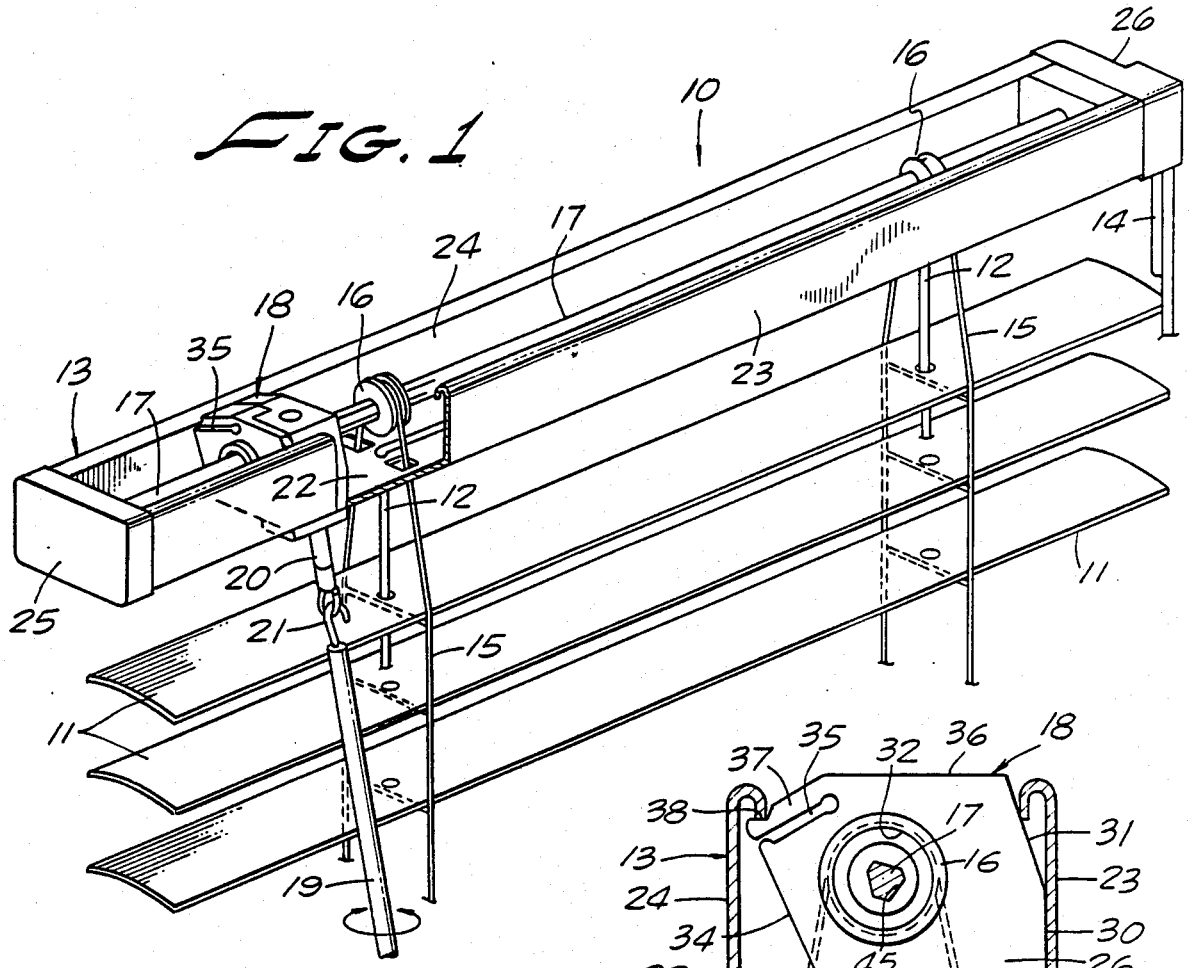
FIG. 1 is a perspective view of a venetian blind showing the tilter apparatus of this invention mounted within the headrail.

Turning now to the drawings and particularly FIG. 1 a slatted window covering or so-called venetian blind is indicated generally as at 10 and is seen to consist generally of a plurality of rectangular slats 11 which are suspended via one or more cords 12 from a headrail 13. In a conventional manner, the slats 11 can be raised or lowered by manipulation of cords 14 typically arranged at one end of the headrail 13. Further cords 15 are arranged to extend along opposite sides of the slats 11 and pass over one or more pulleys 16 which are mounted to turn with an axle or shaft 17 carried within the headrail. In a way that will be more particularly described, rotation of the shaft 17 turns the pulley 16 and the cords 15 to angularly tilt the slats 11 about their longitudinal axes to either increase or decrease, depending upon the direction of rotation, the amount of light that can pass through the blind 10 and thus to increase or decrease visibility through the blind.

The tilter mechanism 18 which will be described in greater detail later herein is mounted onto the end portion of the shaft 17 and received within the confines of the headrail housing. A wand or rod 19 releasably interconnects with a shaft extending from tilter mechanism 18, which on rotation serves to effect rotating of the shaft 17 and pulley 16 moving the cords 15 to adjustably position each of the slats 11 to a common angular relation. The wand is preferably releasably interconnected to the shaft 20 by a hook-and-eyelet arrangement 21 which also provides a kind of universal joint allowing the wand to hang loosely downwardly and be easily moved laterally, when needed.

Figure 3:
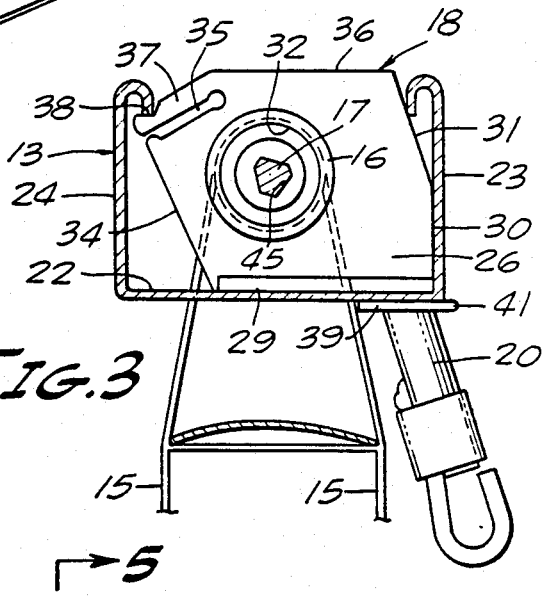
FIG. 3 is an end elevational sectional view taken along the line 3—3 of FIG. 2.
Figure 4:
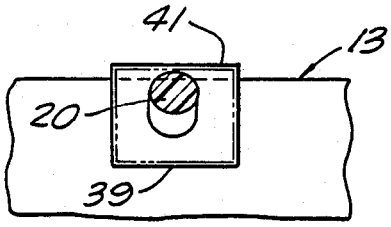
FIG. 4 is a bottom plan, sectional view taken through the tilter actuator along line 4—4 of FIG. 2.
Figure 2:
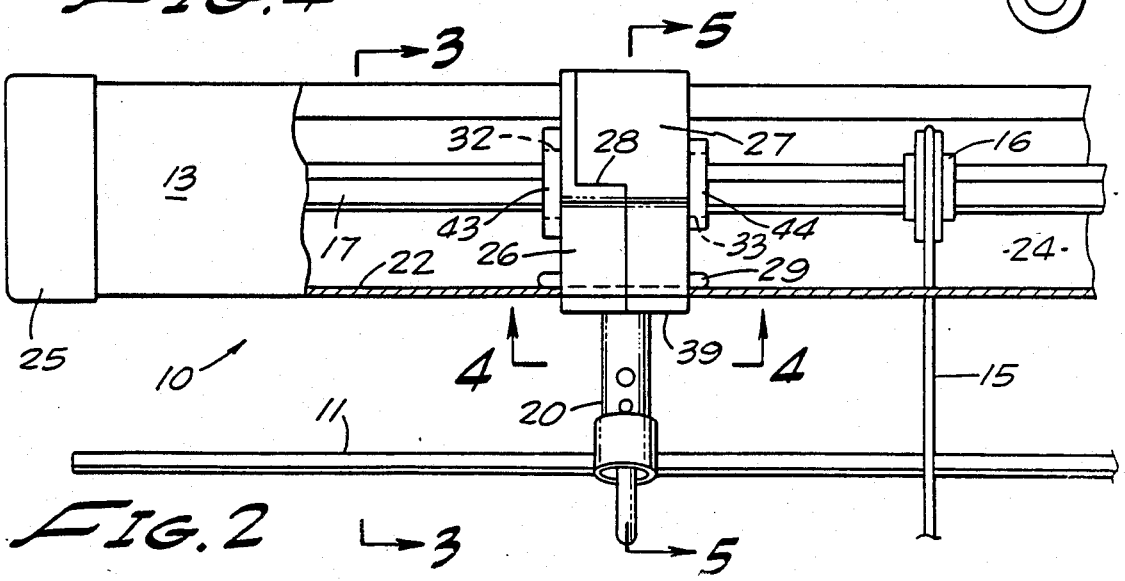
FIG. 2 is a front elevational, partially fragmentary view of the headrail and tilter apparatus.

The headrail 13 consists preferably of a thin metal housing having an elongated rectangular base 22, a front wall 3 integrally related to the base and at substantially 90 degrees thereto, and a rear wall 24 extending in the same direction from the base and parallel to the front wall (FIG. 3). The front and back walls are of substantially the same height with their uppermost edges turned over to extend downwardly a slight amount into the space between the walls (FIG. 3). End caps 25 and 26 fit onto the exposed end edges of the base, front and back walls enhancing rigidity and enclosing the headrail ends for esthetic purposes.

The tilter mechanism 18 enclosure consists preferably of two molded plastic shells 26 and 27 which fit together along the line 28 forming a unitary housing. With particular reference to FIG. 3, the housing is seen to include a flat bottom surface 29 a front facing surface including a first portion 30 at 90 degrees to the bottom surface and a second portion 31 arranged at an acute angle to the bottom surface. Openings 32 and 33 are formed, respectively, in the shells 26 and 27 side walls and are aligned to form a single passageway through which the shaft 17 is received.

The rear or back wall 34 formed by the shells 26 and 27 tapers downwardly toward the bottom surface 29. A slot 35 located closely adjacent the housing top surface 36 and extending inwardly of the back surface 34 forms a cantilever spring plate 37 having an elongated groove 38 on the outer surface thereof running parallel to the aligned openings 32, 33.

In assembly of the tilter mechanism into the headrail, one of the end caps is removed and the shaft 17 is passed through openings 32 and 33. Next, a protruding portion 39 of the lower wall surface 29 and shaft 20 are inserted down through an opening 40 (FIGS. 3 and 5) in the headrail base 22, with a lip 41 on the protruding portion locking underneath the front wall 23. The housing shells are then pressed downwardly into the headrail so that the cantilever spring plate snaps under the downturned edge of the back wall 24 with the wall edge locked into groove 38. When so assembled the housing shells are in flush contact with the headrail base and front wall, and further locked within the headrail by the cantilever spring plate 37 and lip 41. The securement of the tilter mechanism within the headrail is accordingly accomplished without the use of rivets, screws or the like, and in view of the contacting arrangement of the housing shells on their front, rear and bottom surfaces with the headrail housing the entire assemblage is protected against dislodgement or breakage during use.

If breakage or damage to the tilter mechanism should occur, it is easily removed from the headrail by removing an end cap (e.g., cap 25) and releasing the cantilever spring plate 37 by finger pressure.

For the ensuing description of the tilter mechanism operational parts, reference is made to FIGS. 5–9. A spur gear 42 is located within the housing shells 26 and 27 with cylindrical hubs 43, 44 being rotatably located in shell openings 32 and 33. The spur gear has a bore 45 of such geometry and dimensions as to accommodate locking receipt of the shaft 17 therethrough. More particularly, the cross-section of the bore (and the shaft 17) is polygonal which causes the gear and shaft to rotate together.

The spur gear 42 has gear teeth about approximately 270 degrees of its periphery, leaving about 90 degrees lacking teeth and having a smooth surface extending radially outwardly about the same distance as lowest portion or dwell of the gear teeth.

Figure 5:
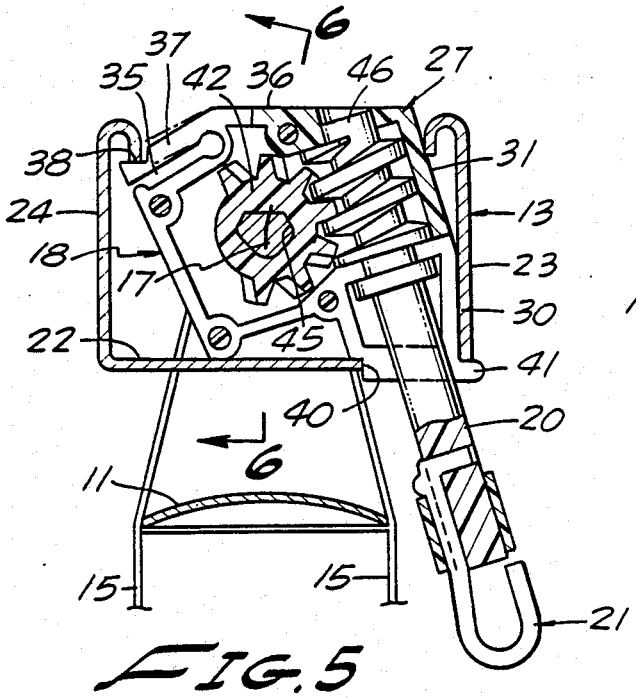
FIG. 5 is an end elevational, sectional view taken along the line 5—5 of FIG. 2 through the tilter apparatus.
Figure 6:
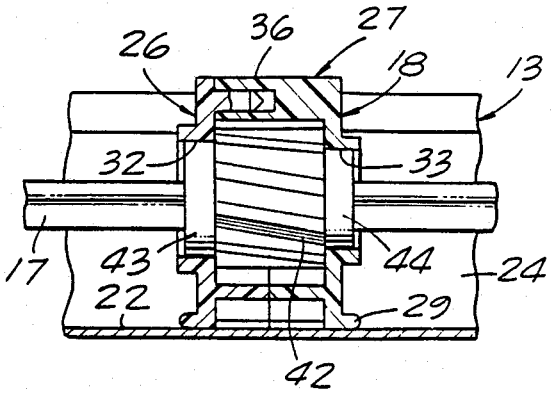
FIG. 6 is a side elevational, sectional view taken along the line 6—6 of FIG. 5.

A worm gear 46 is located within the tilter housing and at such an angle and spacing as to mesh with the spur gear teeth, as can be seen best in FIG. 5. The worm gear is affixed to the end of the adjustment shaft 20, such that rotation of this shaft produces a similar rotation of the worm gear in the same direction.

In operation of the tilter mechanism, assume for initial conditions that the blind slats 11 are horizontal as shown in FIG. 5, which it may be noted is the maximum open position for the blind. Rotation of the tilter wand 19, and thereby the shaft 20 in the direction shown in FIG. 7, if continued will bring the spur gear to the point where the untoothed portion lies directly opposite the worm gear teeth. At this time the slats are at one maximum angular position of adjustment, and further rotation of the wand in the same direction will cause no further adjustment movement of the parts, nor is any reactive force encountered or produced in the gears or the blind.

Figure 7:
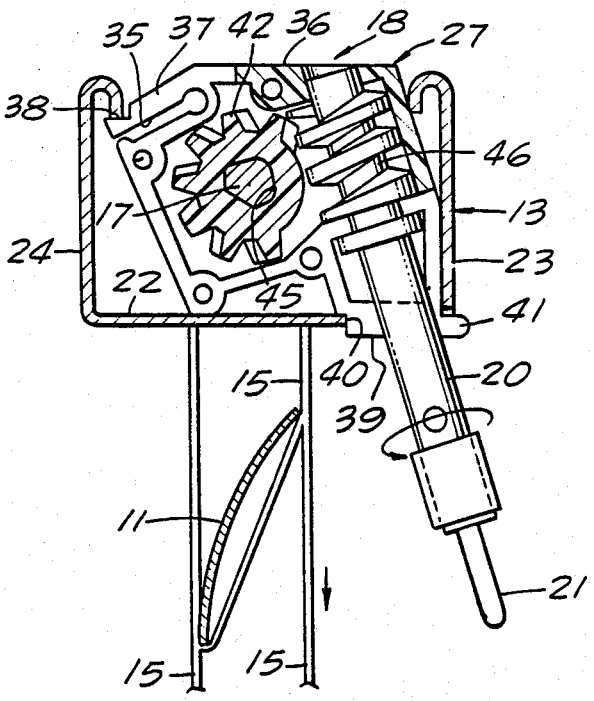
FIGS. 7 and 8 are views similar to FIG. 5 showing the tilter appartus at its two respective extremes of slat adjustment.
Figure 8:
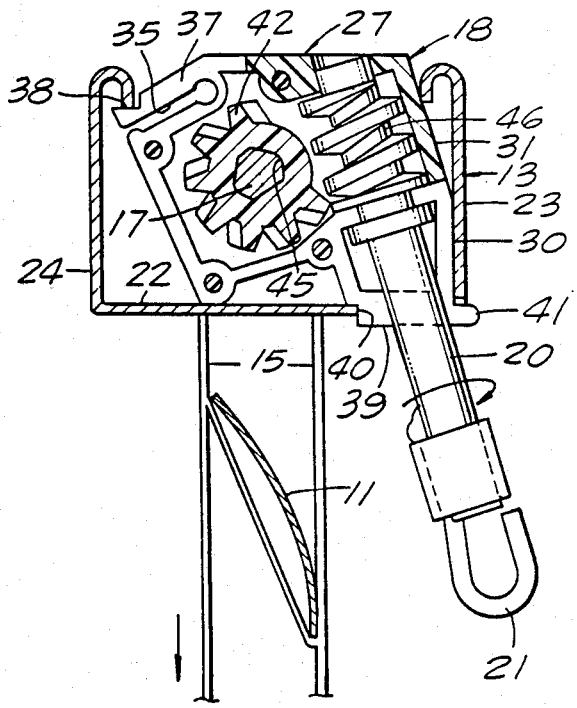
Figure 9:
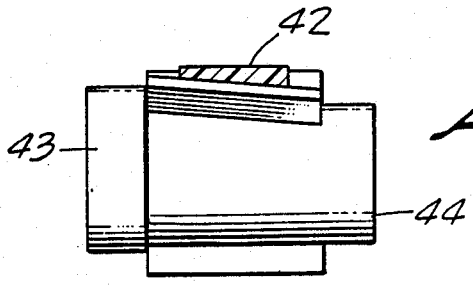
FIG. 9 is a side elevational view of the spur gear looking into the untoothed portion.

Reversing adjustment direction to that shown in FIG. 8 will, starting from either FIGS. 5 or 7 positions, drive the spur gear and the slats in the opposite direction until finally the slats are at the other maximum or extreme of adjustment. As before, further rotation in this same direction is neither resisted nor is additional slat adjustment achieved.

What is claimed is:

1. In a venetian blind tilter mechanism for being releasably and rigidly locked within a generally U-shaped headrail having a base, front and rear walls, the improvement comprising:

a housing constructed of shell-like molded plastic parts fitted together into a unitary arrangement having a flat bottom surface, a front surface joining the bottom surface at substantially 90 degrees, a back surface, a top surface, and two side surfaces, said housing bottom surface including a protrusion for fitting extension through an opening in the headrail base, said protrusion including lip means for locking engagement with an edge of the headrail base opening; and a cantilever spring plate integral with the housing top surface extending angularly downwardly and backwardly beyond the housing back wall, said spring plate compressingly engaging the headrail rear wall to resiliently retain the tilter mechanism within the headrail and said spring plate including a top groove within which a reentrantly curved edge of the headrail back wall is received; the reltive dimensions of the headrail and tilter mechanism housing being such that when the housing is received within the headrail the housing bottom surface is flush against the headrail base, the housing front surfaces abuts with the headrail front wall, and the cantilever spring plate compressingly contacts the headrail back wall.

2. A venetian blind tilter mechanism as in claim 1, further including:

a drive shaft mounted in the headrail;

the housing containing an internal cavity and an opening passing therethrough for rceiving the drive shaft;

a spur gear within the housing cavity mounted for rotation with the drive shaft, and including gear teeth over only a part of the gear periphery leaving a portion of the periphery free from teeth; and a worm gear mounted in the housing cavity in position to mesh with the spur gear teeth and having a shaft connected therewith extending outwardly of the housing;

said headrail including an opening through which the worm gear shaft extends, and the housing has a protrusion surrounding the worm gear shaft and passing through the headrail opening and said protrusion having lip means lockingly engaging a headrail edge defining the headrail opening.

* * * * *